United States Patent [19]

Okui

[11] 4,254,524

[45] Mar. 10, 1981

[54] BOOT TREE

[76] Inventor: Yasuyuki Okui, 5-5, 5 ban-cho, Hiyoshidai, Takatsuki-shi, Osaka-fu, Japan

[21] Appl. No.: 28,793

[22] Filed: Apr. 10, 1979

[30] Foreign Application Priority Data

Dec. 20, 1978 [JP] Japan ..... 53-183144[U]

[51] Int. Cl.[3] ..... A43D 5/00

[52] U.S. Cl. ..... 12/114.6

[58] Field of Search ..... 12/114.6, 114.8

[56] References Cited

U.S. PATENT DOCUMENTS

| | | | |
|---|---|---|---|
| 1,989,597 | 1/1935 | Johnston | 12/114.6 |
| 2,114,677 | 4/1938 | De Woolf | 12/114.6 |
| 3,609,784 | 10/1971 | Goldberg | 12/114.6 |

FOREIGN PATENT DOCUMENTS

| | | | |
|---|---|---|---|
| 2340068 | 2/1976 | France | 12/114.6 |

*Primary Examiner*—Patrick D. Lawson

*Attorney, Agent, or Firm*—Wenderoth, Lind & Ponack

[57] ABSTRACT

A boot tree including shin- and calf-shaped parts, integrally formed with a bow spring. The repulsive force by the bow springs preserves the shape of a boot into which the boot tree is inserted.

1 Claim, 4 Drawing Figures

BOOT TREE

The present invention relates to an improved boot tree, i.e., to an improved leg-shaped device for inserting in a boot to preserve its shape.

Generally, a boot tree consists of two parts which are opposed to each other, and it has been a common practice that, when a conventional boot tree is inserted in a boot, the space between the above-mentioned two parts is broadened by the restoring force of a spring arranged between these two parts. Thus, because of the necessity of incorporating a spring, such conventional boot trees are inevitably high in cost.

It is an object of the present invention to eliminate the above-mentioned disadvantage.

It is an object of the present invention to provide a plastic boot tree comprising shin- and calf-shaped parts, each of which is molded with a bow spring.

It is another object of the present invention to provide a boot tree incorporating a pair of bow springs resilient enough to preserve the shape of a boot.

With these objects in view which will become apparent from the following detailed description, the present invention will be more clearly understood in connection with the accompanying drawings, in which.

Figure 1:
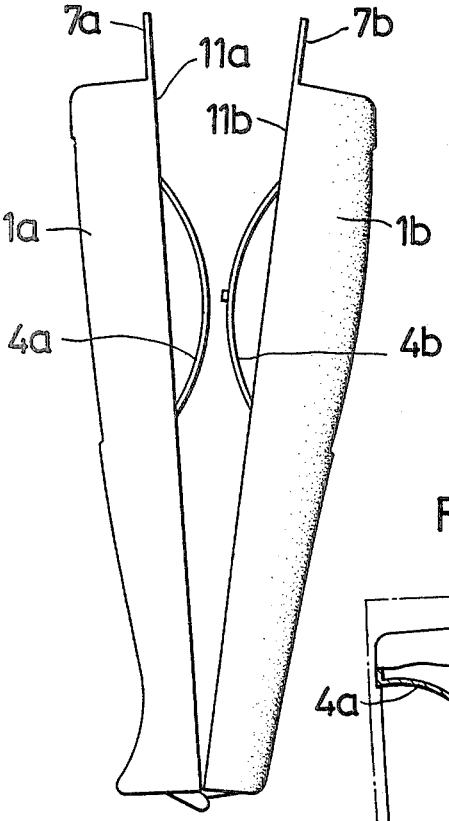
FIG. 1 is a side view of an embodiment of the present invention.

Referring now to FIG. 1, a boot tree in accordance with the present invention includes a shin-shaped part 1*a* and a calf-shaped part 1*b*, each of which is preferably made of semirigid plastics and has a length practically equal to the distance between the top and the foot of a boot. Each of the parts 1*a* and 1*b* is hollow and is open on one side. Brims 11*a* and 11*b* at the open side of the shin- and calf-shaped parts 1*a* and 1*b* respectively are of the same shape so that, when they are put together, the shin- and calf-shaped parts 1*a* and 1*b* form the shape of a leg.

Figure 2:
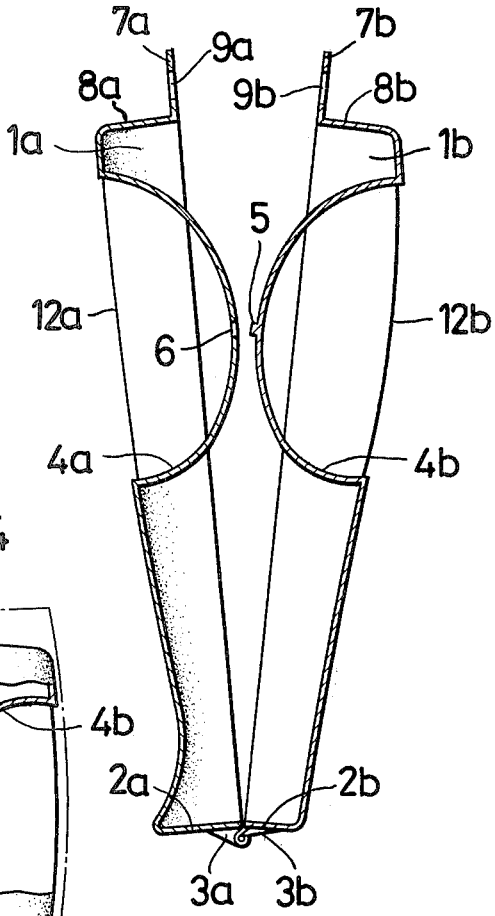
FIG. 2 is a vertical sectional side view thereof.

Referring now to FIG. 2, a bow spring 4*a* extends inwardly in the portion somewhat higher than the mid-portion between a bottom plate 2*a* and a top plate 8*a* of the shin-shaped part 1*a*. The upper and lower ends of the bow spring 4*a* are integral with the shin-shaped part 1*a*. A slit 12*a*, which is practically as narrow as the breadth of the bow spring 4*a*, is formed in the longitudinal ridgeline of the shin-shaped part 1*a* which corresponds to the subtense of the inward bow spring 4*a*. The mid-portion of the arc formed by the inward bow spring 4*a* projects appreciably beyond the plane formed by the brim 11*a*.

A bow spring 4*b* extends inwardly from the outside of the calf-shaped part 1*b* in the same manner and position as the bow spring 4*a*. A slit 12*b* is formed in the longitudinal ridgeline of the calf-shaped part 1*b* in the same manner as the slit 12*a*.

A connector 3*a* is integrally formed on the shin-shaped part 1*a* on the bottom plate 2*a*. The connector half 3*a* is adapted to form a hinge connection with a connector half 3*b* which is integrally formed on the calf-shaped part 1*b* on the bottom plate 2*b*.

A grip 7*a* extends outwardly from the top plate 8*a* in such a manner that one side thereof is on the same plane with the brim 11*a*. A grip 7*b* is similarly provided on top of the calf-shaped part 1*b*. Holes 9*a* and 9*b* provided in the grips 7*a* and 7*b* respectively make it easy to take out the boot tree from a boot.

In order to insert the boot tree into a boot 10, the connector half 3*a* is engaged with the connector half 3*b* so as to form a hinge connection, and the grip 7*a* is held between the thumb and fingers together with a grip 7*b* provided on the edge of the top plate 8*b* in the same manner as the grip 7*a*. Then a sharp pinch is given on the grips 7*a* and 7*b* so that the shin- and calf-shaped parts 1*a* and 1*b* may be brought together. The boot tree will now be easily inserted into the boot 10 with the lower end of the boot tree foremost.

Figure 4:
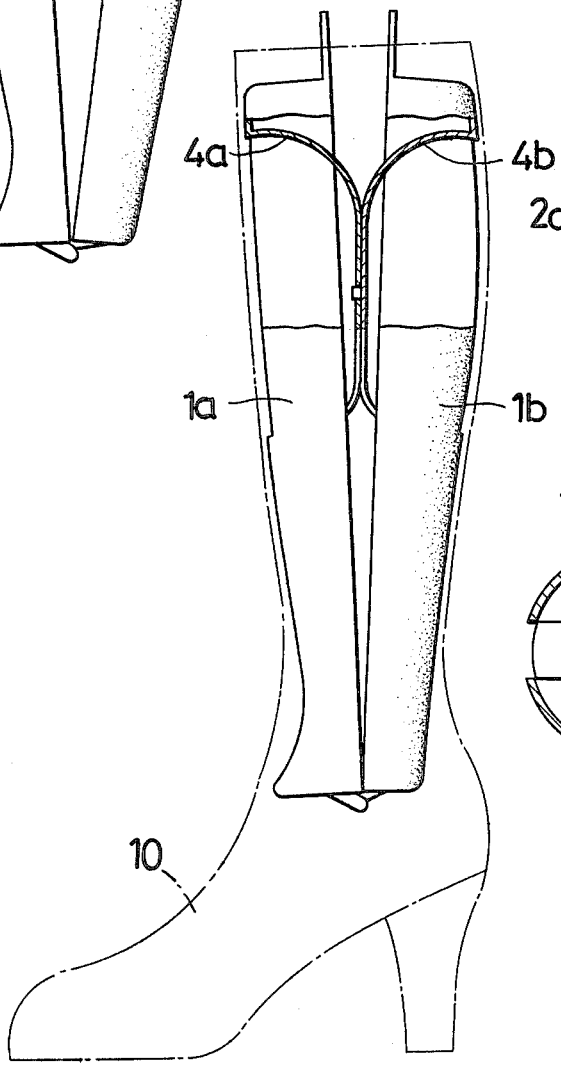
FIG. 4 is a partially cutaway side view of a boot tree in accordance with the present invention inserted in a boot.
Figure 3:
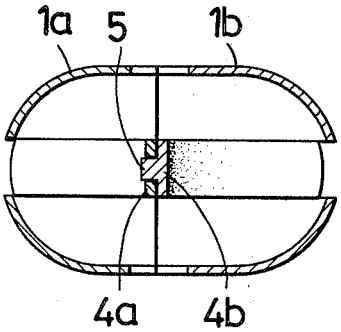
FIG. 3 is a horizontal sectional view thereof.

A protuberance 5 and a hole 6 are provided in the mid-portions of the arcs formed by the inward bow springs 4*b* and 4*a* respectively in such a manner that the protuberance 5 fits into the hole 6 when the shin- and calf-shaped parts 1*a* and 1*b* are put together as shown in FIGS. 3 and 4.

In the boot 10, the space between the shin- and calf-shaped parts 1*a* and 1*b* tends to be broadened by the repulsive power of the bow springs 4*a* and 4*b*. Consequently, the external surfaces of the shin- and calf-shaped parts 1*a* and 1*b* stick fast to the internal surface of the part of the boot 10.

The bow springs 4*a* and 4*b* are resilient enough to preserve the shape of a boot, because the upper and lower ends of these springs are integral with the shin- and calf-shaped parts 1*a* and 1*b*. The protuberance 5 fitting into the hole 6 prevents the bow springs 4*a* and 4*b* from being disengaged from each other while the boot tree is in a boot.

The structure of the shin-shaped part 1*a* and the calf-shaped part 1*b* integral with their bow springs 4*a* and 4*b* permits mass production of the boot tree in accordance with the present invention and thereby permits curtailment of the production cost.

The boot tree in accordance with the present invention can be kept in custody in a limited space by placing the calf-shaped part 1*b* upon the shin-shaped part 1*a* or vice versa in such a manner that the bow spring 4*a* is inserted in the slit 12*b*.

While I have disclosed an embodiment of the present invention, it is to be understood that this has been given by way of example only and not in a limiting sense, the scope of the present invention being determined by the objects and the claims.

What I claim is:

1. A boot tree comprising a shin-shaped part and a calf-shaped part, both of said parts being integrally formed with a bow spring inwardly extending therefrom and being in the shape of an arc with the mid-portion thereof projecting beyond the plane of the inner brim of the respective part, wherein a protuberance is provided in the mid-portion of the arc formed by one of said bow springs and a hole is provided in the mid-portion of the arc formed by the other so that said protuberance fits into said hole when said shin-shaped part and said calf-shaped part are put together, and wherein a slit is formed in the longitudinal ridgeline of said shin-shaped part or said calf-shaped part so that one of them can be placed on the other with the bow spring on said one fitted in said slit in the other.

* * * * *